United States Patent [19]

Oetting et al.

[11] Patent Number: 4,669,443

[45] Date of Patent: Jun. 2, 1987

[54] IGNITION DEVICE FOR SPARK-IGNITED INTERNAL COMBUSTION ENGINE

[75] Inventors: Hermann Oetting; Hans-Joachim Oberg, both of Braunschweig; Dieter Pundt, Calberlah; Willi Binnewies, Helmstedt, all of Fed. Rep. of Germany

[73] Assignee: Volkswagen Aktiengesellschaft, Wolfsburg, Fed. Rep. of Germany

[21] Appl. No.: 807,854

[22] Filed: Dec. 11, 1985

[30] Foreign Application Priority Data

Dec. 14, 1984 [DE] Fed. Rep. of Germany ..... 3445590

[51] Int. Cl.[4] ..... F02P 3/00

[52] U.S. Cl. ..... 123/647; 123/143 C; 123/195 C; 439/125

[58] Field of Search ..... 123/90.38, 143 C, 169 PA, 123/169 PB, 169 PH, 195 C, 198 E, 647; 339/26, 136 C, 143 S

[56] References Cited

U.S. PATENT DOCUMENTS

| | | | |
|---|---|---|---|
| 1,378,260 | 5/1921 | Melton | 123/143 C |
| 1,440,685 | 1/1923 | Korvin-Kroukovsky | 123/143 C |
| 2,463,924 | 3/1949 | van Orden | 339/26 X |
| 2,478,128 | 8/1949 | Peters | 123/143 C |
| 2,686,510 | 8/1954 | Platner | 123/169 PH X |
| 4,515,141 | 5/1985 | Saaf et al. | 123/647 |

FOREIGN PATENT DOCUMENTS

| | | | |
|---|---|---|---|
| 440075 | 1/1927 | Fed. Rep. of Germany | 123/90.38 |
| 2812029 | 9/1979 | Fed. Rep. of Germany . | |
| WO84/00402 | 2/1984 | PCT Int'l Appl. | 123/647 |

*Primary Examiner*—Tony M. Argenbright

*Attorney, Agent, or Firm*—Brumbaugh, Graves, Donohue & Raymond

[57] ABSTRACT

An ignition device for a spark-ignited internal combustion engine wherein the essential components of the ignition device of a spark-ignited internal combustion engine are combined into an assembly unit which, following preassembly, is removably joined with the internal combustion engine.

8 Claims, 6 Drawing Figures

IGNITION DEVICE FOR SPARK-IGNITED INTERNAL COMBUSTION ENGINE

BACKGROUND OF THE INVENTION

The invention concerns an ignition device for a spark-ignition internal combustion engine.

Such ignition devices are known from several proposed renditions—see only DE-OS No. 28 12 029, FO2P 3/02—in such a manner that the components of the ignition device, i.e., the ignition coil and switch gear (in case of a transistorized ignition) fixed on the body, in particular on the wheel arch, of the vehicle equipped with the internal combustion engine, are arranged in a common housing and thus are combined into an assembly unit.

SUMMARY OF THE INVENTION

It is an object of the invention to provide an ignition device in which ignition leads extending openly in the engine compartment are avoided, and wherein it is possible to integrate components of the ignition device provided on the internal combustion engine, for example, an ignition distributor, into the assembly unit.

Pursuant to this object, and others which will become apparent hereafter, one aspect of the present invention resides in a plurality of ignition and electrical components formed in a single assembly unit which extends along the cylinder head over the spark plugs.

One advantage of the invention may be found in its safety, even at high ignition voltages, inasmuch as the ignition leads can be fixedly arranged in the assembly unit and covered. This is particularly true if the housing of the assembly unit is composed of electrically insulating material, at least in some regions.

In another embodiment, an ignition device, namely a device which avoids during assembling processes the customary plug connections at the end facing away from the ignition spark gap, i.e., the outside end, of the spark plug, is defined which can be used to advantage even if the ignition device is not combined into an assembly unit. In any case, there results the advantage that additional maneuvers for producing or separating the plug connections become superfluous since the connections are produced automatically, as it were, on assembly of the plugs or on placement of the assembly unit.

In yet another embodiment the assembly unit can be integrated into the cylinder head so that it comprises also the valve cap and possibly the camshaft bearing end plate. However, in view of the small disassembly and assembly effort, e.g., in case of some defect in the ignition device, it may be advisable to render the assembly unit as a component present in addition to the cylinder head, as defined in a further embodiment. This further embodiment achieves its purpose only within the framework of the ignition device, whereby on placement of the assembly unit onto the cylinder head, all electrical connections between such assembly unit and the spark plugs are produced by way of the plug connections.

The novel features which are considered as charcteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
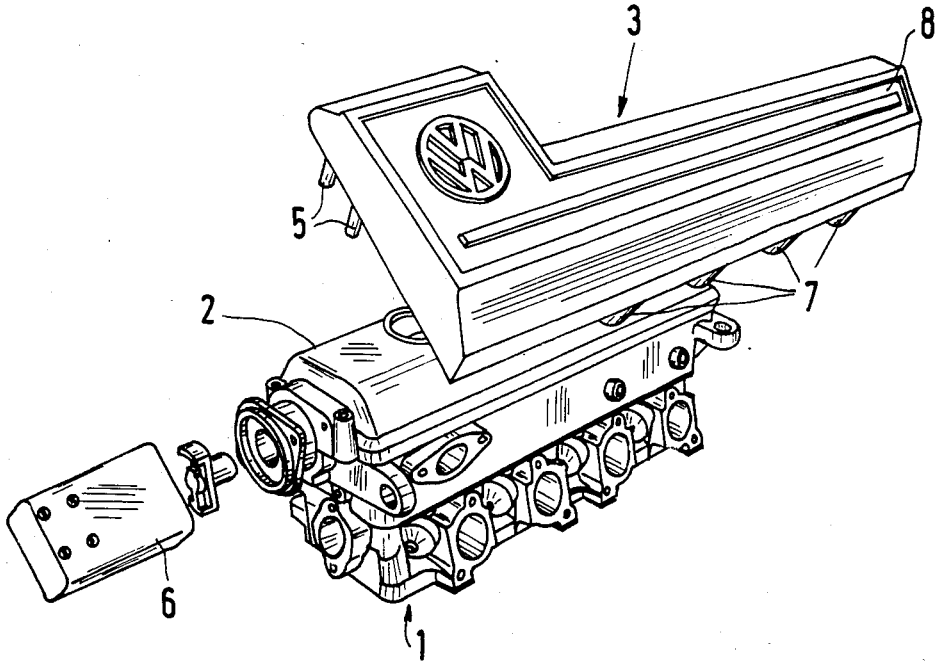
FIG. 1 shows, in perspective, an inclined plan view of an internal combustion engine with the ignition device according to the invention.
Figure 2:
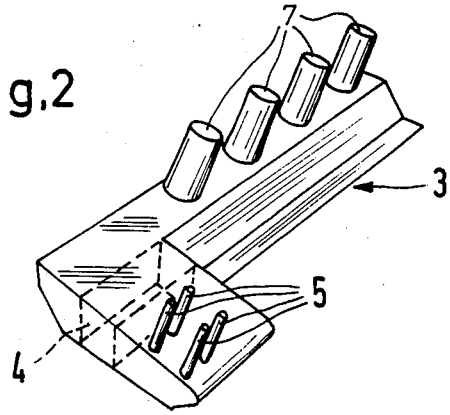
FIG. 2 depicts the ignition device in perspective from below.

Viewing FIGS. 1 and 2, we find that 1 designates the customary cylinder block, and 2 the cylinder head of an internal combustion engine. In accordance with the invention, the high-voltage-side components of the ignition device—here a coil ignition device—are combined so as to form the assembly unit 3 which in this case, in addition to all ignition leads, contains the ignition coil 4, the plug 5 for connection of the ignition distributor 6 arranged in this case on the side of the engine, as well as plugs 7 which with opposite contacts, not shown, form plug connections for four spark plugs of a four-cylinder internal combustion engine 1. It becomes clear in particular from FIG. 1 that the region 8 of the assembly unit 3 may also be designated as an ignition strip since, in the manner of a strip, it covers all spark plugs.

At this point, it should be mentioned that as a matter of principle, it is also possible to integrate the ignition distributor 6 in full or in part into the assembly unit 3.

The axes of the various plug connections with their components 5 and 7 extend parallel to one another so that the plug connections are produced when the assembly unit 3 is put in place. The assembly unit is then joined to the combustion engine additionally, e.g., by means of screw bolts.

Customarily, the voltage delivery to the spark plugs is effected by means of plug connections within the region of the outer ends of the plugs facing away from the spark gaps. Difficulties may then occur, for example, when the alignment of the axes of the spark plugs does not coincide with the assembly direction of the assembly unit 3 or if relatively large assembly tolerances are to be expected, this is particularly so when essential components of the ignition device are combined in the manner described so as to form an assembly unit. In such a case, it may be useful, as explained with reference to FIG. 3, to provide for connections adjacent to the spark plugs, as it were, so that one has full freedom in the alignment of the axes of the connections, and to arrange the voltage feeds to the spark plugs radially on the latter. Even if essential components of the ignition device are not combined into an assembly unit, such a rendering of the voltage feeds offers the advantage that additional manipulations for creating the necessary electrical connections on the spark plugs can be dispensed with in that the connections on the spark plugs can be dispensed with in that the connections are produced automatically when the spark plugs are screwed in.

Figure 3:
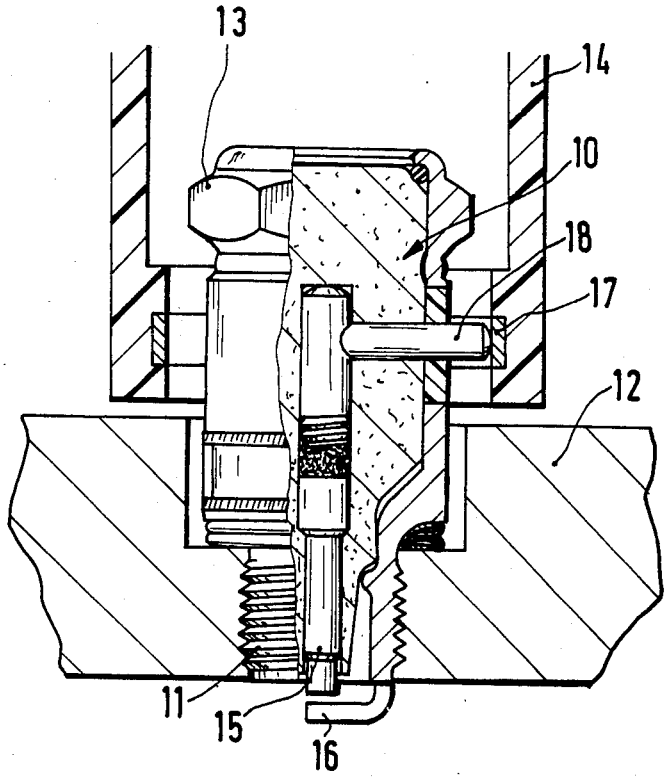
FIG. 3 is a cross section through the internal combustion engine within the region of a spark plug.

Viewing FIG. 3, it is seen that the spark plug 10 with its thread 11 is screwed in the customary manner into the cylinder head 12 of the engine while its upper end, provided with the hexagonal head 13 for engagement of a wrench, is placed within the insulating sleeve 14 which constitutes a component of the assembly unit 3 designated in FIGS. 1 and 2. The voltage supply to the center electrode 15 (the counter electrode is designated by 16) is not obtained in the manner customary for spark plugs by means of a plug connection at the outer end of the spark plug 10, but rather radially by way of a contact ring 17 on the insulating sleeve 14. The contact ring is electrically connected with the ignition distributor, and a contact pin 18 which extends radially, is placed on the level of the contact ring 17 and in the screwed-in state of the spark plug 10 produces an electrically conducting connection between the center electrode 15 and the contact ring 17.

Obviously it is possible to cause, in particular the contact pin 18 which extends towards the outside to bear elastically on the contact ring 17 through the use of springs. In such a case, additional electrical plug connections between the assembly unit 3, on the one hand, and the internal combustion engine, on the other end, becomes unnecessary.

Figure 5:
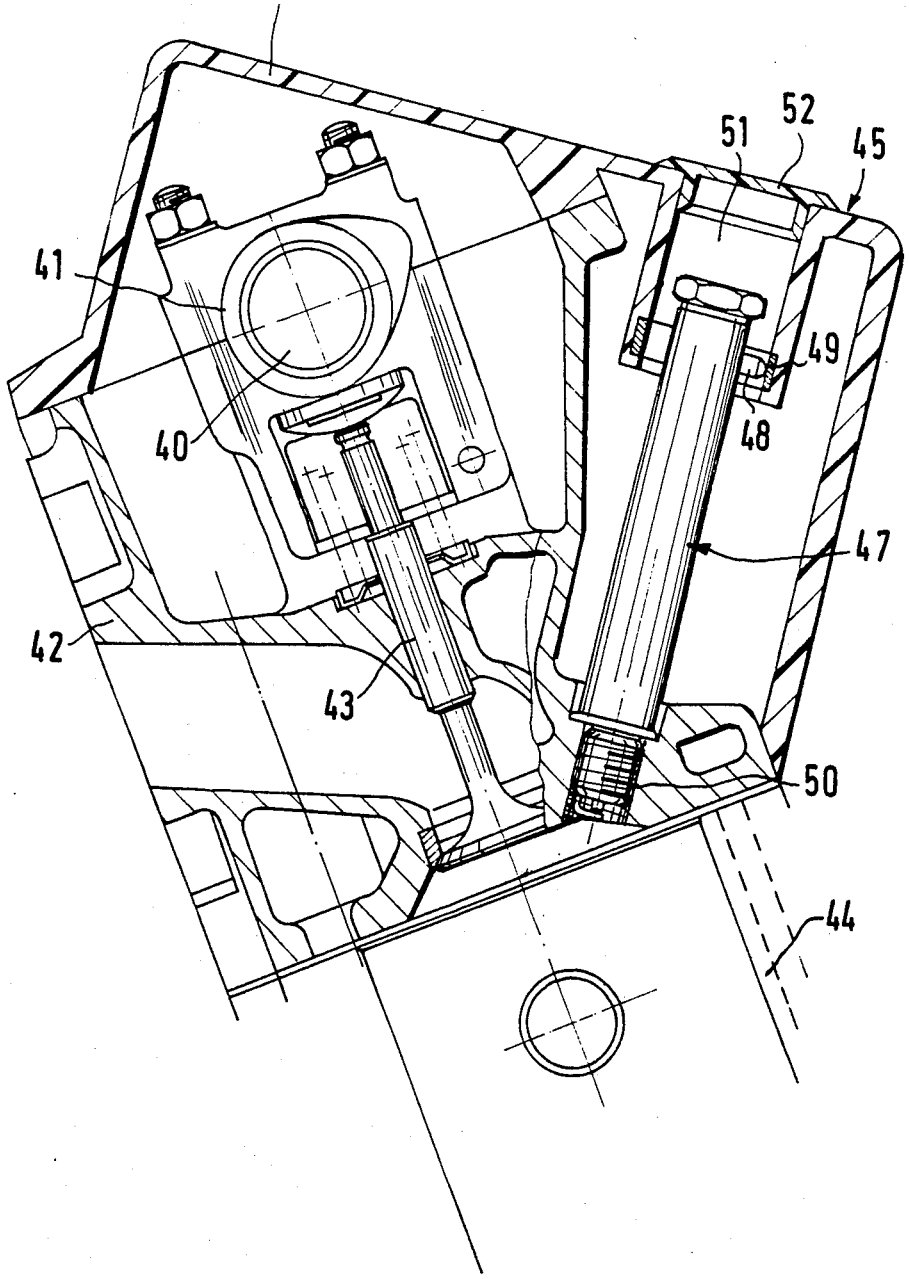
Figure 6:
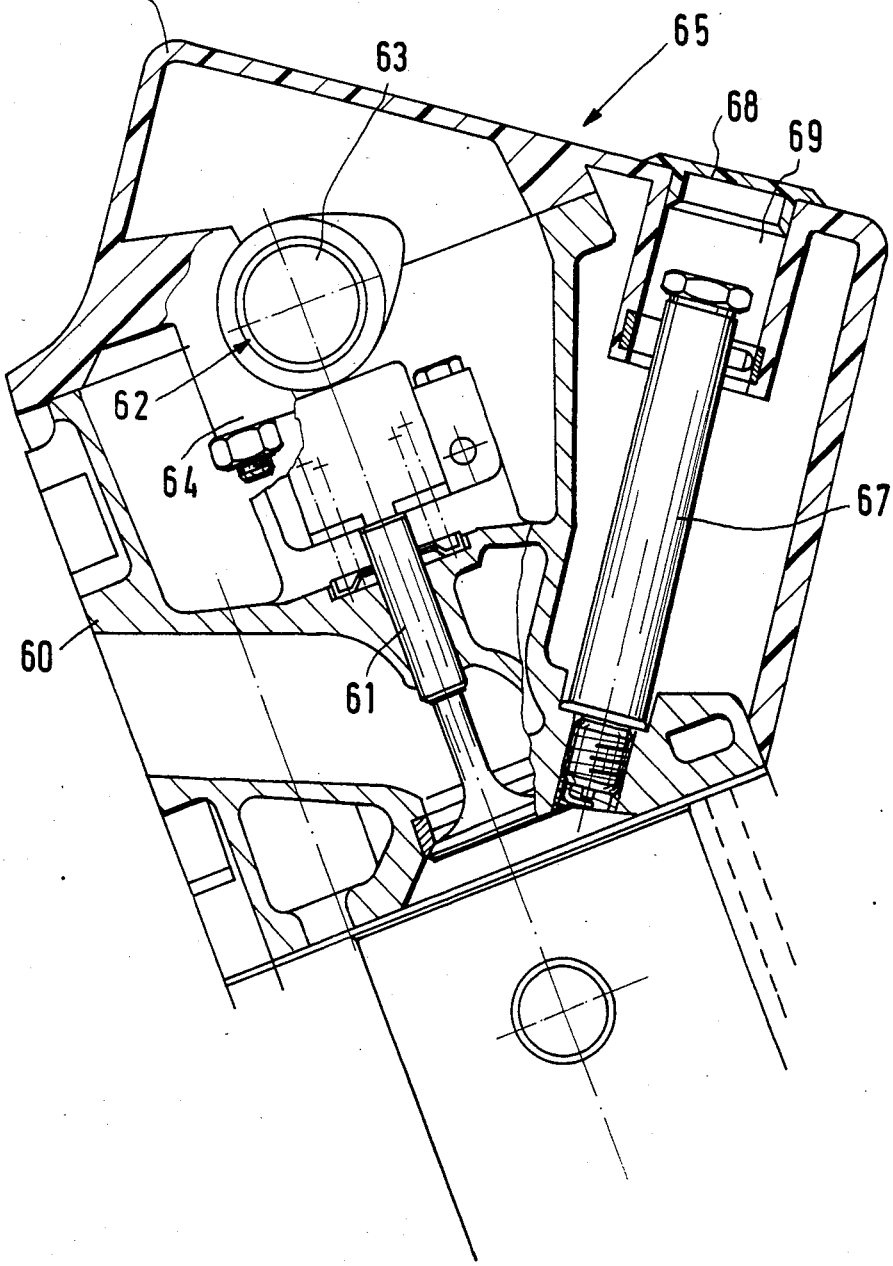

It should now be pointed out that such a construction is employed for the voltage supply to the spark plug in the examples of embodiments according to FIGS. 5 and 6 which have not yet been described.

Figure 4:
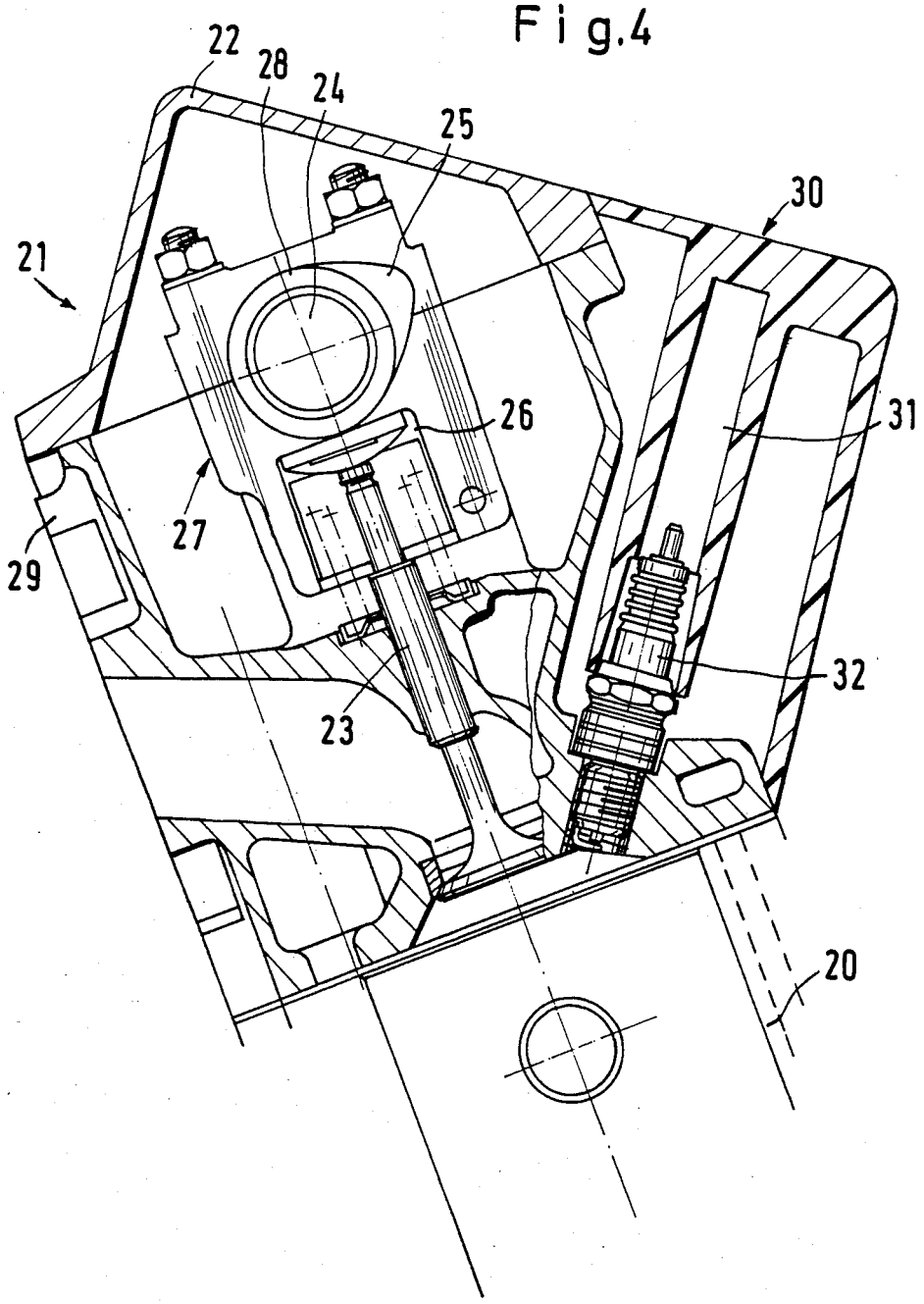
FIGS. 4, 5 and 6 are cross sections through other embodiments of the invention.

These two figures, like FIG. 4, show a cross section through the internal combustion engine in the zone of a reciprocating gas valve.

Viewing FIG. 4, we find above the cylinder block 20 the cylinder head 21 with the cylinder head cover 22 which covers the control of the reciprocating gas valve 23 containing essentially the camshaft 24 with the cam 25 and the cupshaped tappet 26. The camshaft bearing 27 with the bearing end plate 28 forms, in this embodiment, a component of the cylinder head 29 proper. Parallel to the cylinder head extends again the assembly unit 30 which comprises the essential components of the ignition device and is provided with blind holes 31 which are to receive one spark plug 32 each. The cylinder head cover 22 and the outer walls of the assembly unit 30 form together, as shown in FIG. 4, an approximately box-like housing, thus constituting an upper cover of the cylinder head 29 proper. Here again, open ignition leads have been avoided. The assembly unit is composed essentially of insulating material.

Whereas in the example of an embodiment as per FIG. 4, the cylinder head 21 and, respectively, cylinder head cover 22, on the one hand, and the assembly unit 30, on the other hand, are separate from each other, FIGS. 5 and 6 display a joining of these two elements. Viewing initially FIG. 5, we find that here again, the camshaft 40 with its bearing 41 is rendered as a component of the cylinder head 42 proper. In 43 we find again a valve serving the gas reversal of the cylinder concerned in the cylinder block 44. In this embodiment, however, the assembly unit 45, which comprises the essential components of the ignition device, extends with its wall prolongation 46 forming the cylinder head cover over the space occupied by the valve control so that the assembly unit 45 and the cylinder head cover 46 constitute a single unit which in this embodiment is joined removably by means of screw bolts with the cylinder head 42 proper.

As mentioned above, the spark plug 47 in this embodiment is provided with contact means on the outside, namely, through its radially directed contact 48 and the contact ring 49 fixed in the assembly unit 45. The spark plug is screwed into the cylinder head 42 proper at 50 in the customary manner. For ease of spark plug exchange, a clearance 51 is provided for each spark plug in the assembly unit 45 which clearance can be closed off by means of a removable closing plug 52. Accordingly, spark plug replacement is possible without disassembly of the assembly unit 45, solely by removal of the plug 52.

In a further embodiment shown in FIG. 6, the integration of cylinder head and assembly unit has been carried even further. It is true that the cylinder head 60 here again contains the guide for the gas reversal valve 61. However, the entire bearing 62 for the camshaft 63, including also the camshaft bearing plate 64, forms a component of the assembly unit which as a whole is designated by 65 and accommodates the essential components of the ignition and also comprises the cylinder head cover 66. Here again, the assembly unit is provided with an assembly opening 69 covered with a removable stopper 68 for each of the spark plugs 67, so that no disassembly of the assembly unit 65 is needed when a spark plug has to be replaced or the internal combustion engine, following removal of the spark plug, is subjected to examination.

In comparison with combinations of ignition components fixed, e.g., on the wheel arch of the vehicle, all examples of embodiments offer the advantage that ignition cables freely hanging in the engine compartment are avoided.

The voltage leads to the spark plugs may also be constituted contact-less by spark gaps in the assembly unit, in a manner known in itself.

While the invention has been illustrated and described as embodied in an ignition device for a spark-ignited internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

We claim:

1. An ignition device for a spark-ignited internal combustion engine equipped with spark plugs in a cylinder head and containing engine components such as high-voltage generators, ignition distributors, ignition leads and electrical connections, the device comprising: one assembly unit removably fastenable on the cylinder head and provided so as to extend along the cylinder head over the spark plugs, said assembly unit being formed so as to contain a plurality of these engine components including components for connecting the spark plugs, said components for connecting spark plugs having axes which extend in the direction of assembly of said unit on the cylinder head, said assembly unit being further formed with assembly clearances at the site of the spark plugs so that the spark plugs are replaceable without removing said assembly unit; and electrical connectors serving as voltage feeds to the spark plugs, said connectors being provided so as to be at the outer circumference of the spark plugs so that they are electrically connectable with one another upon insertion of the spark plugs.

2. An ignition device as defined in claim 1, wherein said assembly unit is integrated into the cylinder head.

3. An ignition device as defined in claim 2, wherein said assembly unit is formed so as to contain bearing components for a camshaft of the internal combustion engine.

4. An ignition device as defined in claim 3, wherein said assembly unit is further formed so as to provide a cylinder-head cover of the internal combustion engine.

5. An ignition device as defined in claim 2, wherein said assembly unit is further formed so as to provide a cylinder-head cover of the internal combustion engine.

6. An ignition device as defined in claim 1, wherein characterized in each of said connectors includes at least one contact ring and an opposite contact facing said contact ring radially and being electrically connectable thereto, one of said opposite contact and said contact ring being integral with the spark plug, and the other being integral with said assembly unit.

7. An ignition device as defined in claim 1, wherein said assembly unit has a housing with at least some regions made of an electrically insulating material.

8. An ignition device as defined in claim 1; and further comprising plugs insertable in said assembly clearances so as to close off said clearances.

* * * * *